US012733722B2

(12) United States Patent
Wang

(10) Patent No.: US 12,733,722 B2
(45) Date of Patent: Sep. 15, 2026

(54) PULL HANDLE DEVICE, CONTAINER WITH PULL HANDLE, AND SUITCASE

(71) Applicant: GUANGZHOU LIMITLESS TECHNOLOGY CO., LTD., Guangzhou (CN)

(72) Inventor: Kaihong Wang, Guangzhou (CN)

(73) Assignee: GUANGZHOU LIMITLESS TECHNOLOGY CO., LTD., Guangzhou (CN)

( * ) Notice: Subject to any disclaimer, the term of this patent is extended or adjusted under 35 U.S.C. 154(b) by 0 days.

(21) Appl. No.: 19/415,675

(22) Filed: Dec. 10, 2025

(65) Prior Publication Data

US 2026/0198669 A1 Jul. 16, 2026

(30) Foreign Application Priority Data

Jan. 16, 2025 (CN) ..... 202510071415.6

(51) Int. Cl.

| | |
|---|---|
| ***A45C 5/03*** | (2006.01) |
| ***A45C 13/26*** | (2006.01) |
| ***A45C 13/28*** | (2006.01) |
| ***A45C 13/30*** | (2006.01) |

(52) U.S. Cl.

CPC ..... *A45C 13/262* (2013.01); *A45C 5/03* (2013.01); *A45C 13/28* (2013.01); *A45C 13/30* (2013.01); *A45C 2013/267* (2013.01); *A45C 2013/306* (2013.01)

(58) Field of Classification Search

CPC ..... A45C 13/262; A45C 5/03; A45C 13/28; A45C 13/30; A45C 2013/267; A45C 2013/306

USPC ..... 190/102

See application file for complete search history.

(56) References Cited

U.S. PATENT DOCUMENTS

| | | | | |
|---|---|---|---|---|
| 6,550,102 | B1 * | 4/2003 | Liang | A45C 13/262 280/655 |
| 7,392,888 | B2 * | 7/2008 | Lai | A45C 13/04 190/126 |
| 11,464,309 | B2 * | 10/2022 | McKelvey | A47G 25/1442 |
| 2007/0266527 | A1 * | 11/2007 | Chen | A45C 13/26 16/431 |

(Continued)

FOREIGN PATENT DOCUMENTS

| | | |
|---|---|---|
| CN | 208388020 U | 1/2019 |
| CN | 209898555 U | 1/2020 |

(Continued)

*Primary Examiner* — Nathan J Jenness
*Assistant Examiner* — Jessica Kavini Tamil
(74) *Attorney, Agent, or Firm* — BAYES PLLC

(57) ABSTRACT

A pull handle device, a container with pull handle, and a suitcase, are provided. The pull handle device includes: two rods arranged along a first direction, and a handle arranged along a second direction to connect the two rods; the handle includes a gripping structure and a hanging structure provided on at least one side of the gripping structure, the hanging structure includes a groove and a protrusion connected to each other, the protrusion is located on a side of the handle, and the groove is connected to the protrusion; a projection of the groove along the second direction overlaps at least partially with a projection of the two rods along the second direction, and the groove includes at least: an inclined portion and a curved portion connected to each other.

19 Claims, 19 Drawing Sheets

(56) References Cited

U.S. PATENT DOCUMENTS

| | | | | |
|---|---|---|---|---|
| 2017/0086556 | A1* | 3/2017 | Yoshida | A45C 13/28 |
| 2025/0176685 | A1* | 6/2025 | McKelvey | A45C 5/03 |

FOREIGN PATENT DOCUMENTS

| | | | |
|---|---|---|---|
| CN | 211139129 | U | 7/2020 |
| CN | 222217359 | U | 12/2024 |

* cited by examiner

PULL HANDLE DEVICE, CONTAINER WITH PULL HANDLE, AND SUITCASE

CROSS-REFERENCE TO RELATED APPLICATIONS

This application claims the benefit of priority to Chinese Application No. 202510071415.6, filed on Jan. 16, 2025, which is incorporated herein by reference in its entirety.

TECHNICAL FIELD

The present disclosure relates to the field of handles, and in particular, to a pull handle device, a container with pull handle, and a suitcase.

BACKGROUND

A handle may be provided in movable containers to facilitate user handling. The designs of the handle can be provided to adapt to the user's height and usage habits to enhance grip feel and provide structural support for bearing weight.

SUMMARY

One or more implementations of the present disclosure provide a pull handle device, including: two rods arranged along a first direction, and a handle arranged along a second direction to connect the two rods. The handle includes a gripping structure and a hanging structure provided on at least one side of the gripping structure. The hanging structure includes a groove and a protrusion connected to each other. The protrusion is located on a side of the handle, and the groove is connected to the protrusion. The range of a projection of the groove along the second direction overlaps at least partially with a range of a projection of the rod along the second direction, and the groove includes at least: an inclined portion and a curved portion connected to each other. The inclined portion is inclined with respect to the second direction, and the inclined portion is configured to: when a hung structure of a hung object comes into contact with the inclined portion, guide, by the inclined portion, at least a part of the hung structure to the curved portion. The curved portion is configured to, when the hung structure applies force to the curved portion due to gravity of the hung object, create an angle between a direction of the force and the first direction, with the direction of the force pointing away from a center of the handle.

In some implementations, the inclined portion includes a first end and a second end, the first end having a height in the first direction greater than a height of the second end in the first direction, and the second end being connected to the curved portion.

In some implementations, the groove further includes: a vertical portion, the vertical portion being connected to the curved portion, the curved portion being located between the inclined portion and the vertical portion, and the vertical portion being provided by a side wall of the protrusion.

In some implementations, the groove further includes: a first chamfer connected to the inclined portion and a second chamfer connected to the vertical portion.

In some implementations, the protrusion has a height in the first direction greater than a height of the gripping structure in the first direction.

In some implementations, an upper portion of the protrusion in a third direction has a width greater than a width of a lower portion of the protrusion in the third direction, the third direction being perpendicular to the first direction and the second direction.

In some implementations, the handle includes a first part connecting the two rods and a second part fixed above the first part, the second part enclosing an upper surface of the first part and a part of both sides of the first part. An upper portion of the second part forms the hanging structure.

In some implementations, a lower portion of the first part forms two rod connecting portions for connecting the two rods respectively.

In some implementations, there is a parting line between the second part and the first part, the parting line including: a straight-line portion in the middle and arc portions on both sides of the straight-line portion.

In some implementations, a minimum distance from the inclined portion to the parting line in the first direction is not less than ½ of a minimum distance from the gripping structure to the parting line in the first direction; and a minimum distance from the curved portion to the parting line in the first direction is not less than ½ of a minimum distance from the gripping structure to the parting line.

In some implementations, the first part and the second part enclose to form an accommodating space, a button mechanism being provided inside the accommodating space. A part of a button of the button mechanism protrudes from the second part.

In some implementations, the first part and the second part are fixedly connected by one or more fasteners. One of the first part or the second part is provided with a positioning hole, and the other of the first part and the second part is provided with a first positioning post. The fastener passes through the positioning hole and is fixedly connected to the first positioning post. The first positioning post is located within the accommodating space, and the first positioning post abuts an inner wall of one of the first part or the second part.

In some implementations, the first part and the second part enclose to form an accommodating space. The first part is provided with a positioning protrusion, the second part is provided with a second positioning post, and the second positioning post abuts the positioning protrusion. A range of a projection of the second positioning post along the second direction is within a range of a projection of the rod along the second direction.

In some implementations, side walls on both sides of the handle in the second direction are curved. Side walls on both sides of the handle in a third direction are curved, the third direction being perpendicular to the first direction and the second direction.

In some implementations, a range of a projection of the groove along the second direction is within a range of a projection of the rod along the second direction.

In some implementations, the gripping structure has a width of 130-150 mm in the second direction. The groove has a depth of 7-9 mm in the first direction, and the groove has a width of 11-13 mm in the second direction.

In some implementations, each side of the gripping structure of the handle is provided with a hanging structure.

One or more implementations of the present disclosure provide a container with pull handle, including a container and any of the above pull handle devices.

In some implementations, the container with pull handle further includes: a rod bottom support provided at a lower part of the container, a rod main plate provided at an upper part of the container, and a rod tube provided between the rod bottom support and the rod main plate. A part of the rod of the pull handle device is slidably provided within the rod tube.

One or more implementations of the present disclosure provide a suitcase, including any of the above pull handle devices.

BRIEF DESCRIPTION OF DRAWINGS

The present disclosure will be further described by way of exemplary implementations, which will be described in detail with reference to the drawings. The same reference numerals in the drawings indicate the same structures or devices.

Figure 1:
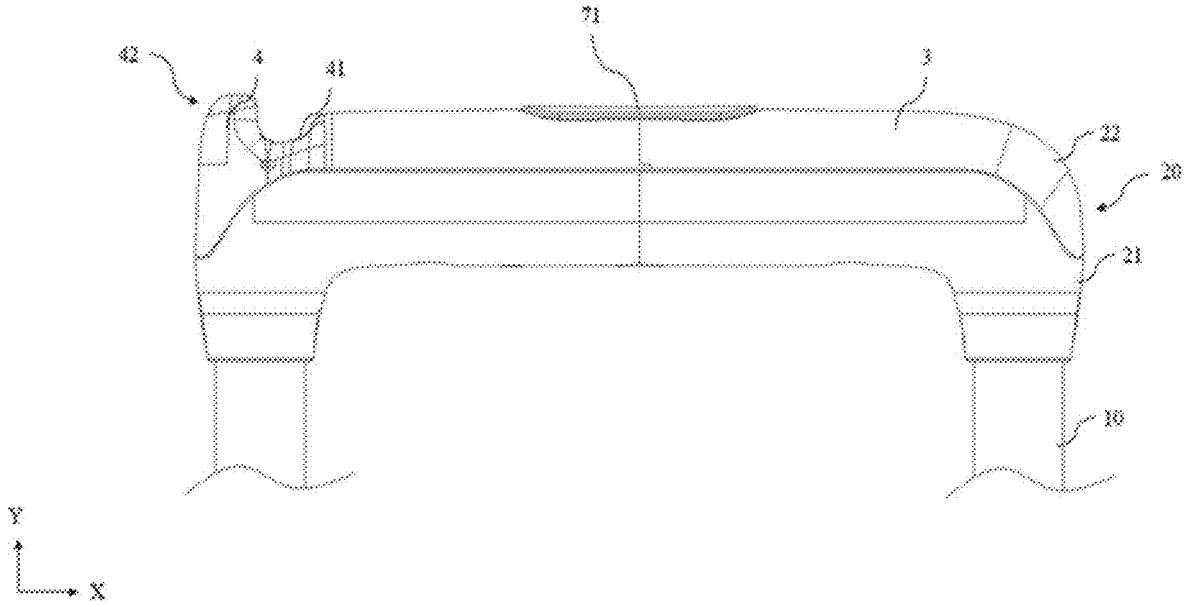
FIG. 1 is a schematic diagram of a pull handle device according to some implementations of the present disclosure.

In the drawings: 100 pull handle device; 10 rod; 20 handle; 30 hung structure; 21 first part; 211 rod connecting portion; 22 second part; 3 gripping structure; 4 hanging structure; 41 groove; 42 protrusion; 51 first chamfer; 52 inclined portion; 53 curved portion; 54 vertical portion; 55 second chamfer; 61 parting line; 611 straight-line portion; 612 arc portion; 7 button mechanism; 71 button; 81 container; 82 rod bottom support; 83 rod main plate; 84 rod tube; 85 backpack; 851 strap; 91 positioning hole; 92 first positioning post; 93 positioning protrusion; 94 second positioning post.

DETAILED DESCRIPTION

In order to more illustrate the technical solutions of the implementations of the present disclosure, the following will provide a detailed description of the implementations in conjunction with the accompanying drawings. It is obvious that the content described below is some examples or implementations of the present disclosure, and for those of ordinary skill in the art, it is also possible to apply the technical solutions or means disclosed in the present disclosure to other scenarios without creative labor.

It should be understood that the terms "system," "device," "unit," and/or "module" used in the present disclosure are a way to distinguish different levels of different components, elements, parts, portions, or devices. However, if other words can achieve the same purpose, the above words may be replaced by other expressions.

Unless otherwise specified, the technical terms describing components, elements, etc. in the present disclosure are not limited to the singular and may also include the plural. In general, terms such as "include" and "contain" only indicate that the steps, elements, or components explicitly identified are included, and these steps, elements, and components do not constitute an exclusive list, and the described method or device may also include other steps or components.

It should be understood that the coordinate systems involved in the present disclosure are mainly used to help understand the relative positional relationships of the components, rather than the absolute positions of the components in space. The coordinate systems involved in the present disclosure (for example, XYZ coordinate systems) may be three-dimensional rectangular coordinate systems or three-dimensional oblique coordinate systems.

In some movable containers, in order to facilitate the user to move the container, a handle for the user to grip may be provided. In some implementations, in order to adapt to the user's height or usage habits, the handle may adopt a telescopic design, for example, a telescopic pull handle. In some implementations, the telescopic pull handle may include a rod tube fixedly connected to the container, and a rod telescopically connected relative to the rod tube and relatively fixed, and the handle is fixed to the rod, thereby allowing the user to adjust the height of the handle relative to the container, and allowing the user to store the rod inside the rod tube to save storage space.

In some implementations, the movable container may include an open or semi-open container, such as a flatbed trailer, transfer box, etc., or may include a closed container, such as a backpack, suitcase, etc. In some cases, the user may have a need to temporarily hang an object on the pull handle. In some related implementations, considering the gripping feel, the pull handle has a smooth surface profile structure, making it difficult to hang objects. In other related implementations, an independent hook is installed on the pull handle, but such a hook affects the gripping feel, and the hook is prone to lateral bending or even falling off the pull handle when bearing weight.

Based on this, one or more implementations of the present disclosure provide a pull handle device, which meets the user's hanging needs by providing a groove for hung objects on the pull handle, and enables the pull handle as a whole to bear greater weight without deformation or falling off through the design of the groove.

Figure 2:
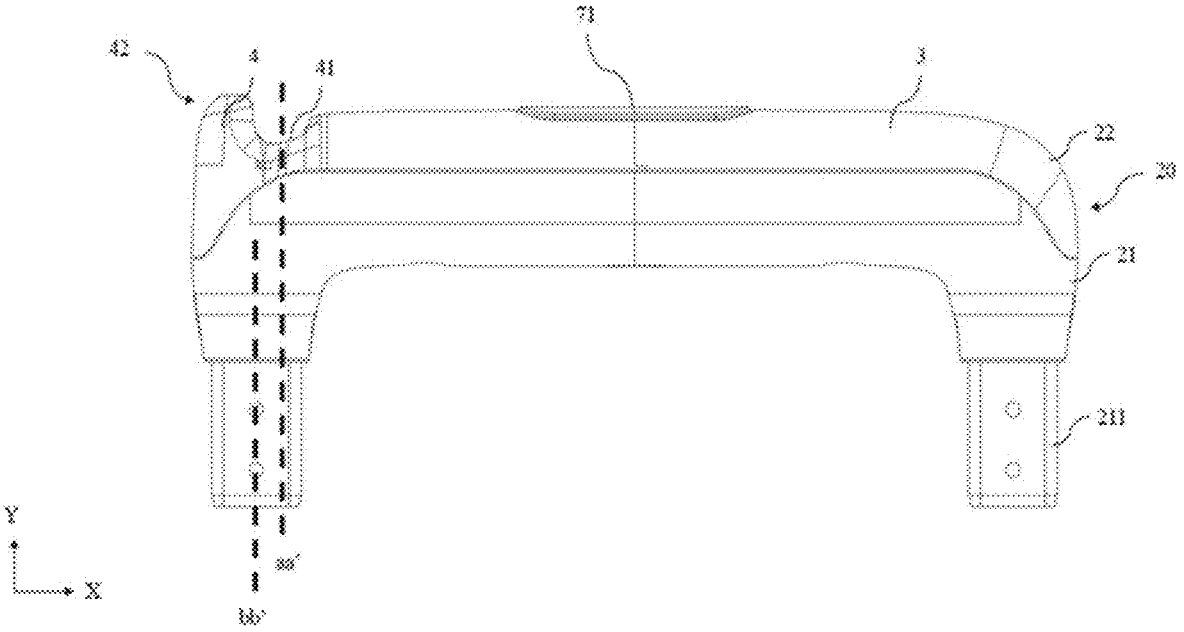
FIG. 2 is a schematic diagram of the handle of the pull handle device according to some implementations of the present disclosure.

FIG. 1 is a schematic diagram of a pull handle device according to some implementations of the present disclosure, and FIG. 2 is a schematic diagram of the handle of the pull handle device according to some implementations of the present disclosure. Referring to FIG. 1, FIG. 2, and in conjunction with FIG. 3 to FIG. 7, in one or more implementations of the present disclosure, the pull handle device may include: two rods 10 arranged along a first direction, and a handle 20 arranged along a second direction to connect the two rods 10. In some implementations, the first direction may be the extension direction or pull-out direction of the rod 10, for example, the Y-axis direction in the figure, and the second direction may be the extension direction of the handle 20, for example, the X-axis direction in the figure. In some implementations, the extension direction of the handle 20 may be perpendicular to the extension direction of the rod 10, that is, the X-axis direction is perpendicular to the Y-axis direction. In some implementations, the extension direction of the handle 20 may not be perpendicular to the extension direction of the rod 10, for example, there is an angle between the X-axis direction and the Y-axis direction that is not 0° and not 90°, at this time, the handle 20 may be slightly inclined to adapt to the angle of human grip. In some implementations, the rod 10 and the handle 20 may be fixedly connected by a fastener (such as a bolt, etc.), or may be welded, riveted, or integrally formed.

In some implementations, the handle 20 includes a gripping structure 3 and a hanging structure 4 provided on at least one side of the gripping structure 3. The hanging structure 4 includes a groove 41 and a protrusion 42 connected to each other. The protrusion 42 is located on a side of the handle 20, and the groove 41 is connected to the protrusion 42. In some implementations, the gripping structure 3 of the handle 20 extends in the X-axis direction, and one end of the gripping structure 3 is recessed downward to form the groove 41. In some implementations, referring to FIG. 1 and FIG. 2, the bottom of the groove 41 is lower than the upper surface of the gripping structure 3 in the X-axis direction. In some implementations, the end of the groove 41 (for example, the left end of the groove 41 in FIG. 1 and FIG. 2) extends upward to form the protrusion 42.

In some implementations, the groove 41 provides a hanging position for the hanging structure (for example, the handle, rope, chain, etc. of a bag containing contents) of the object to be hung. In some implementations, the protrusion 42 may be used to block the hanging structure from disengaging from the groove 41.

In some implementations, the range of a projection of the groove 41 along the second direction overlaps at least partially with a range of a projection of the rod 10 along the second direction, so as to facilitate the transfer of the force (load) borne by the groove 41 to the rod 10. In some implementations, the range of a projection of the groove 41 along the second direction may be within the range of a projection of the rod 10 along the second direction, so that the component of the force borne by the groove 41 in the second direction can be directly transferred to the rod 10, rather than being borne by the structural strength of the handle 20 itself. In some implementations, the recessed direction of the groove 41 may face the rod 10.

In some related implementations, the groove is provided in the middle of the handle rather than at the rod, and the component of the force borne by the groove in the first direction (that is, the component in the X-axis direction, or the lateral force) is borne by the side wall of the groove, and the component of the force borne by the groove in the second direction (that is, the component in the Y-axis direction, or the normal force) is borne by the bottom of the groove. At this time, the groove resists the component of the force in the second direction through the rigidity of the material of the handle itself, and the component in the second direction will cause the handle to bend downward, which is likely to cause damage to the handle when hanging a heavy weight. In one or more implementations of the present disclosure, the groove 41 transfers the component of the force in the second direction to the rod 10, and the middle of the handle 20 does not bear the force, so it will not cause deformation and damage to the middle of the handle 20, and the side of the handle is effectively supported by the rod 10 and can bear a greater load.

In some implementations, the groove 41 includes at least: an inclined portion 52 and a curved portion 53 connected to each other, and the inclined portion 52 and the curved portion 53 are arranged adjacent to each other. In some implementations, referring to FIG. 1, FIG. 2, and FIG. 7, the inclined portion 52 is closer to the gripping structure 3 than the curved portion 53, and the curved portion 53 is located on the outer side of the handle 20 relative to the inclined portion 52 (for example, the left side in FIG. 1 and FIG. 2). In some implementations, the range of a projection of the inclined portion 52 and/or the curved portion 53 along the second direction may overlap at least partially with the range of a projection of the rod 10 along the second direction, so that at least a part of the component of the force borne by the inclined portion 52 and/or the curved portion 53 in the second direction can be transferred to the rod 10. That is, at least one of the inclined portion 52 or the curved portion 53 at least partially vertically overlaps with the rod 10. In other implementations, the range of a projection of the inclined portion 52 and the curved portion 53 along the second direction may be within the range of a projection of the rod 10 along the second direction, so that the component of the force borne by the inclined portion 52 and/or the curved portion 53 in the second direction can be transferred to the rod 10.

In one or more implementations of the present disclosure, the inclined portion 52 is inclined with respect to the second direction, for example, the inclined portion 52 forms an angle with the X-axis direction that is not 0° and not 90°. In some implementations, the inclined portion 52 is configured to: when a hung structure of a hung object comes into contact with the inclined portion 52, guide, by the inclined portion 52, at least a part of the hung structure to the curved portion 53.

Figure 16:
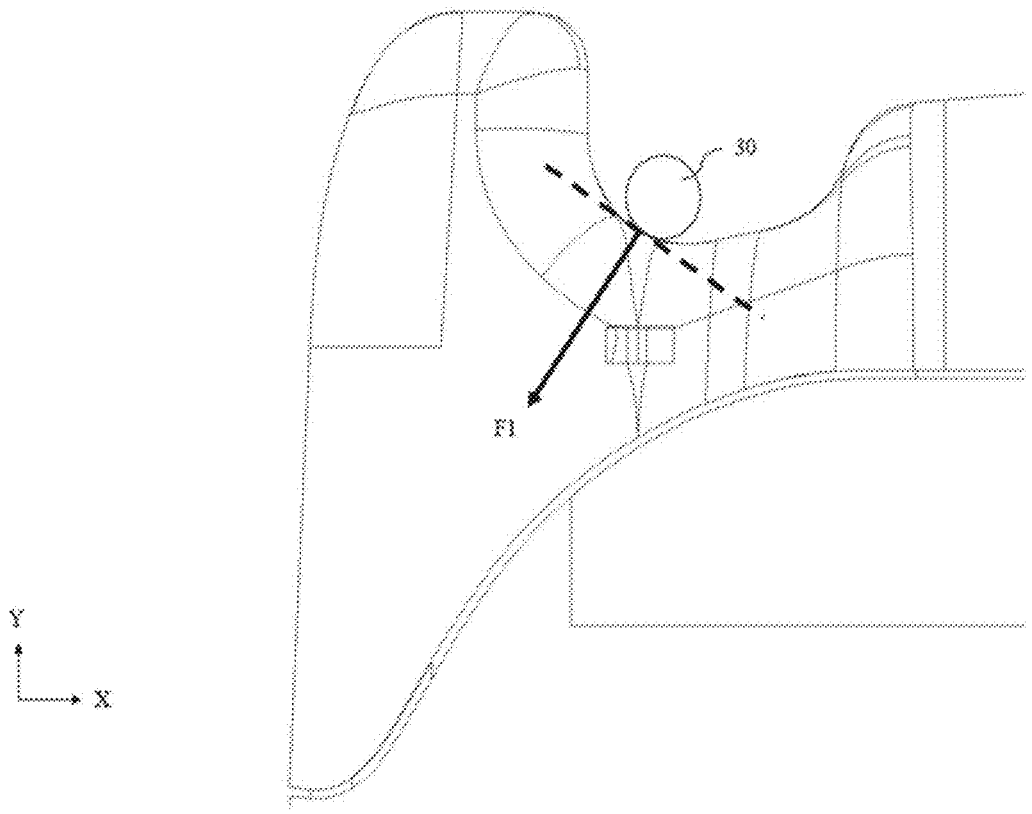
FIG. 16 to FIG. 19 are force schematic diagrams of the groove of the pull handle device according to some implementations of the present disclosure.

For example, referring to FIG. 16, if the hung structure 30, such as a handle, has a small diameter, specifically, the diameter of the hung structure 30 is less than the width of the inclined portion 52, when the hung structure 30 is hung into the groove 41, the hung structure 30 slides down along the inclined direction of the inclined portion 52 into the curved portion 53.

For example, if the hung structure 30, such as a handle, has a large diameter, specifically, the diameter of the hung structure 30 is greater than the width of the inclined portion 52, when the hung structure 30 is hung into the groove 41, based on the inclined setting of the inclined portion 52, the hung structure 30 has a tendency to move toward the curved portion 53.

Figure 17:
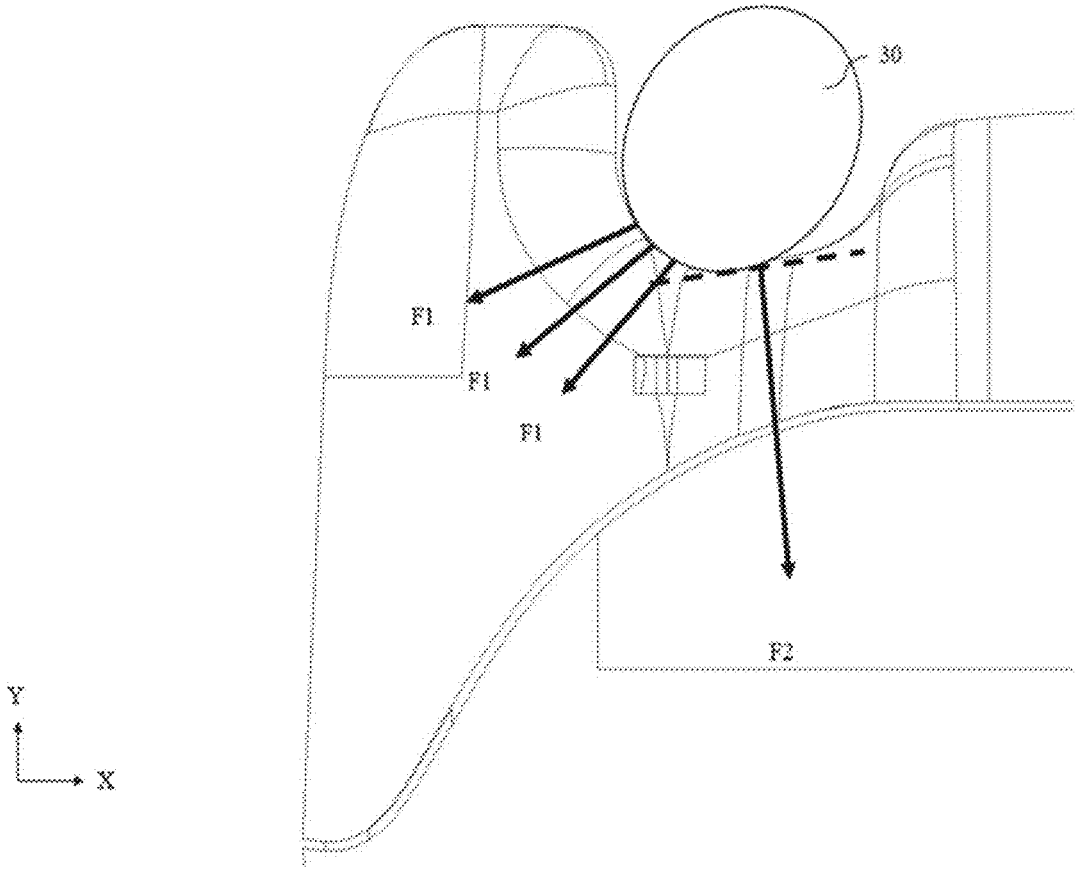

In some implementations, if the hung structure 30 is flexible, referring to FIG. 17, a part of the handle deforms and enters the curved portion 53, making contact and fitting with part or all of the curved portion 53, and applies force to one or more positions at the fitting location of the curved portion 53, or further simultaneously applies force to the inclined portion 52.

Figure 18:
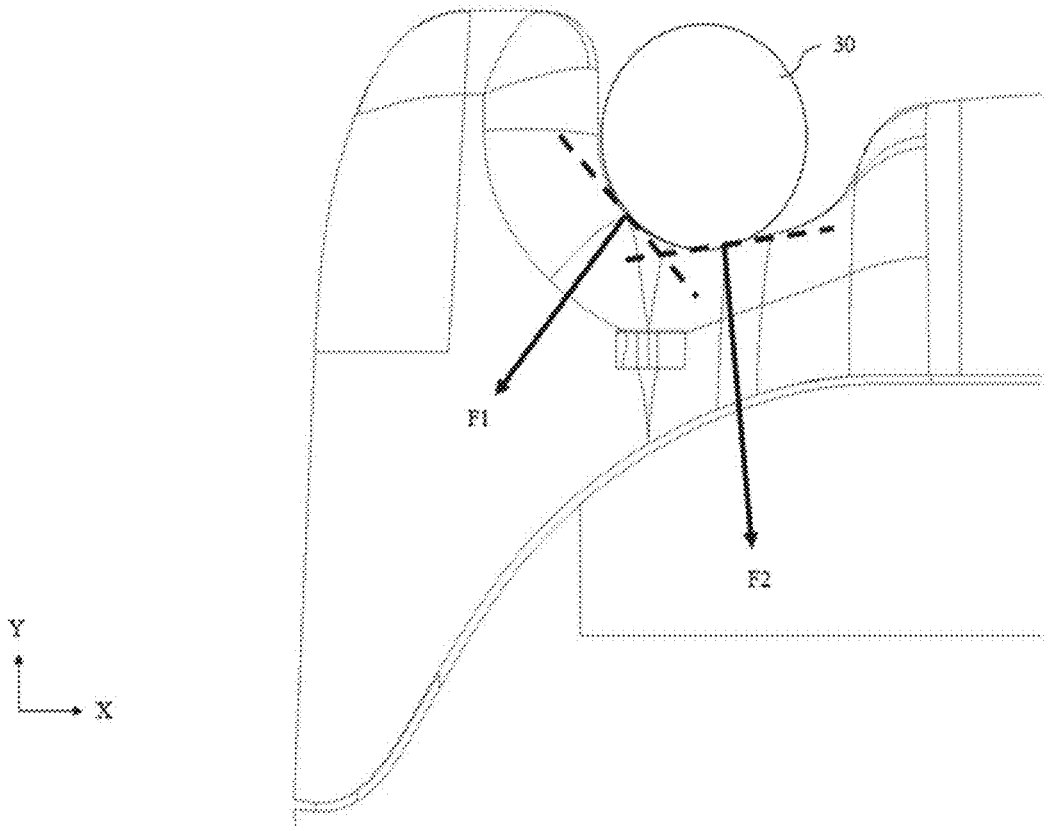
Figure 19:
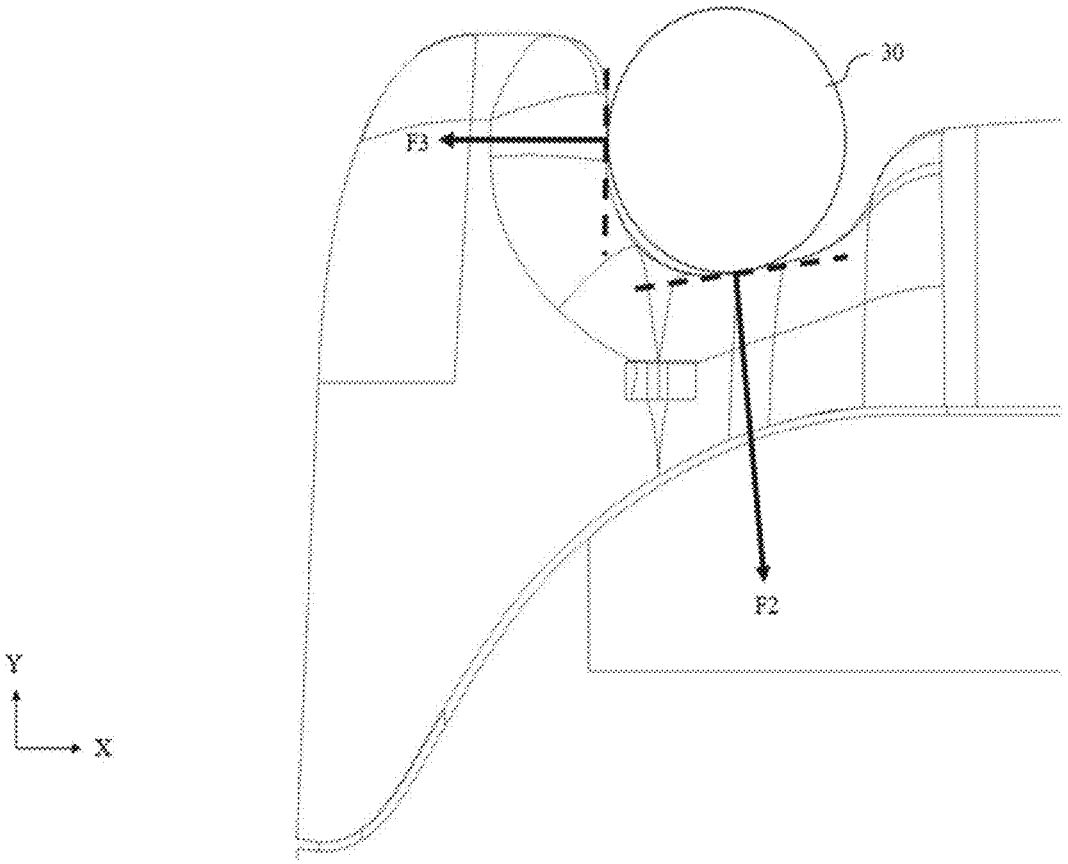

In some implementations, if the hung structure 30 is rigid, referring to FIG. 18 and FIG. 19, one side of the cross-section of the hung structure 30 contacts the curved portion 53 (as in FIG. 18) or contacts the protrusion 42 (as in FIG. 19), while the other side of the cross-section of the hung structure 30 contacts the inclined portion 52, and simultaneously applies force to the curved portion 53 and the inclined portion 52.

In one or more implementations of the present disclosure, the curved portion 53 is configured to, when the hung structure 30 applies force to the curved portion 53 due to gravity of the hung object, create an angle between a direction of the force and the first direction, with the direction of the force pointing away from a center of the handle 20. In some implementations, the angle is an acute angle.

In some implementations, continuing to refer to FIG. 16 to FIG. 19, force F1 is the force applied by the hung structure 30 to the curved portion 53, force F2 is the force applied by the hung structure 30 to the inclined portion 52, and force F3 is the force applied by the hung structure 30 to the side wall of the protrusion 42. The direction indicated by the arrows of force F1, force F2, and force F3 is the direction of each respective force. In some implementations, the curved portion 53 cooperates with the inclined portion 52, so that most of the force provided by the hung structure 30 is converted into a component in the first direction and transferred to the rod 10.

In some implementations, the inclined portion 52 and the curved portion 53 are located on both sides of the center of the groove 41, respectively. In other words, the inclined portion 52 is located on one side (for example, the right side in FIG. 7) of the bottom of the groove 41, and the curved portion 53 is located on the other side (for example, the left side in FIG. 7) of the bottom of the groove 41. In some implementations, referring to the dashed lines in FIG. 2, the right dashed line aa' roughly shows the center position of the groove 41, and the left dashed line bb' roughly shows the center position of the rod 10. In some implementations, the center of the groove 41 is offset relative to the center of the rod 10, so that the overall curved portion 53 can face the center of the rod 10. In some working environments, the load is most likely guided to the curved portion 53 through the inclined portion 52, and is decomposed into a smaller component in the second direction and a larger component in the first direction. Therefore, the solution in which the curved portion 53 faces the center of the rod 10 enables the rod 10 to better bear the load.

In some implementations, the inclined portion 52 includes a first end (for example, the right end in FIG. 7) and a second end (for example, the left end in FIG. 7), the first end having a height in the first direction greater than a height of the second end in the first direction, and the second end being connected to the curved portion 53. In some implementations, the inclined portion 52 may be a curved surface or a spatial curved surface (e.g., multi-axis curved surface). In some implementations, the profile of the projection of the inclined portion 52 in the third direction perpendicular to the first direction and the second direction (for example, the Z-axis direction in FIG. 4 and FIG. 5, that is, the direction perpendicular to the plane of the drawing in FIG. 1 and FIG. 2) may be a straight line. In other implementations, the profile of the projection of the inclined portion 52 in the third direction may be a curve, such as a concave arc, convex arc, wavy line, or irregular arc.

In some implementations, the curved portion 53 includes a third end (for example, the left end in FIG. 7) and a fourth end (for example, the right end in FIG. 7), the third end having a height in the first direction greater than a height of the fourth end in the first direction, and the fourth end of the curved portion 53 being connected to the second end of the inclined portion 52. In some implementations, the fourth end of the curved portion 53 and the second end of the inclined portion 52 are the lowest points (e.g., a local minimum in the height) of the groove in the first direction. In some implementations, the hung structure may fall into this lowest point, so that the inclined portion 52 and the curved portion 53 can simultaneously bear the force applied by both sides of the hung structure, thereby increasing the force-bearing area, reducing the pressure, and improving the load-bearing capacity of the inclined portion 52 and the curved portion 53.

Figure 7:
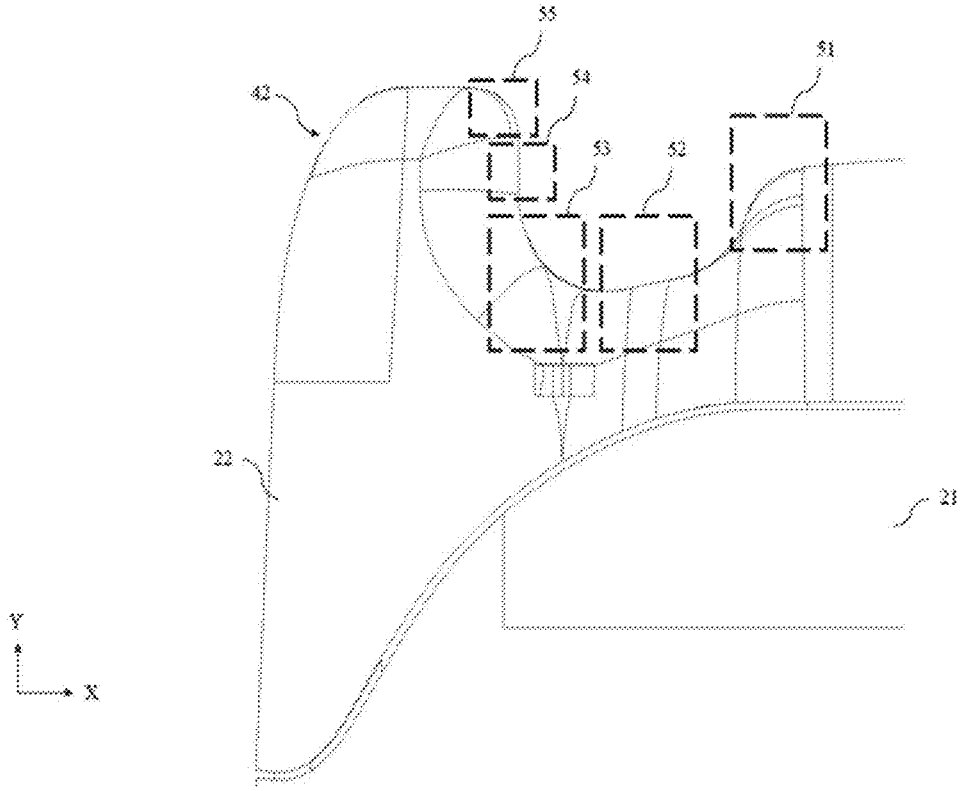
FIG. 7 is an enlarged schematic diagram of the groove and the protrusion of the handle of the pull handle device according to some implementations of the present disclosure.
Figure 8:
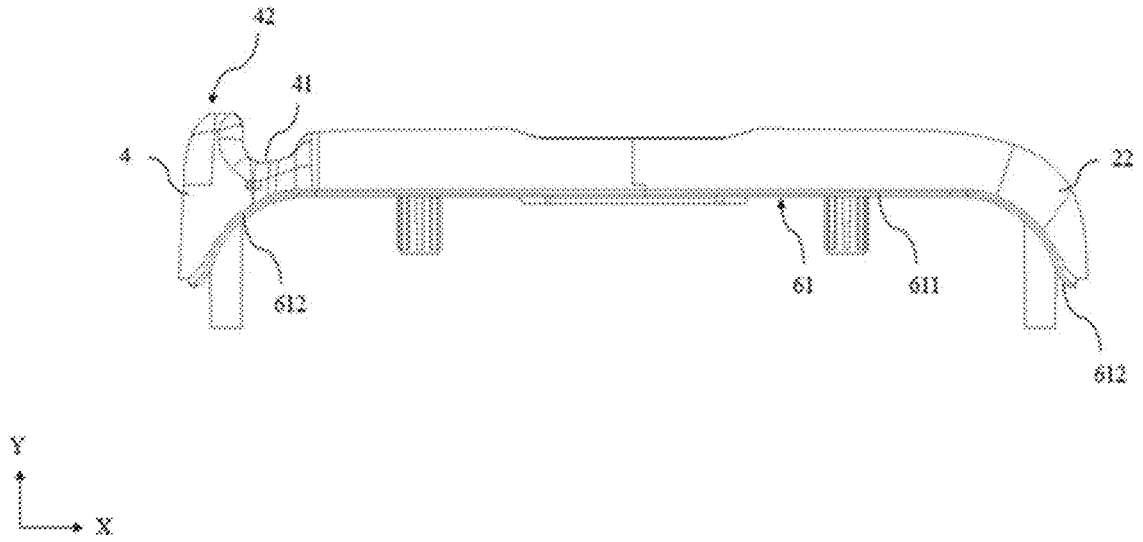
FIG. 8 is a schematic diagram of the second part of the handle of the pull handle device according to some implementations of the present disclosure.
Figure 9:
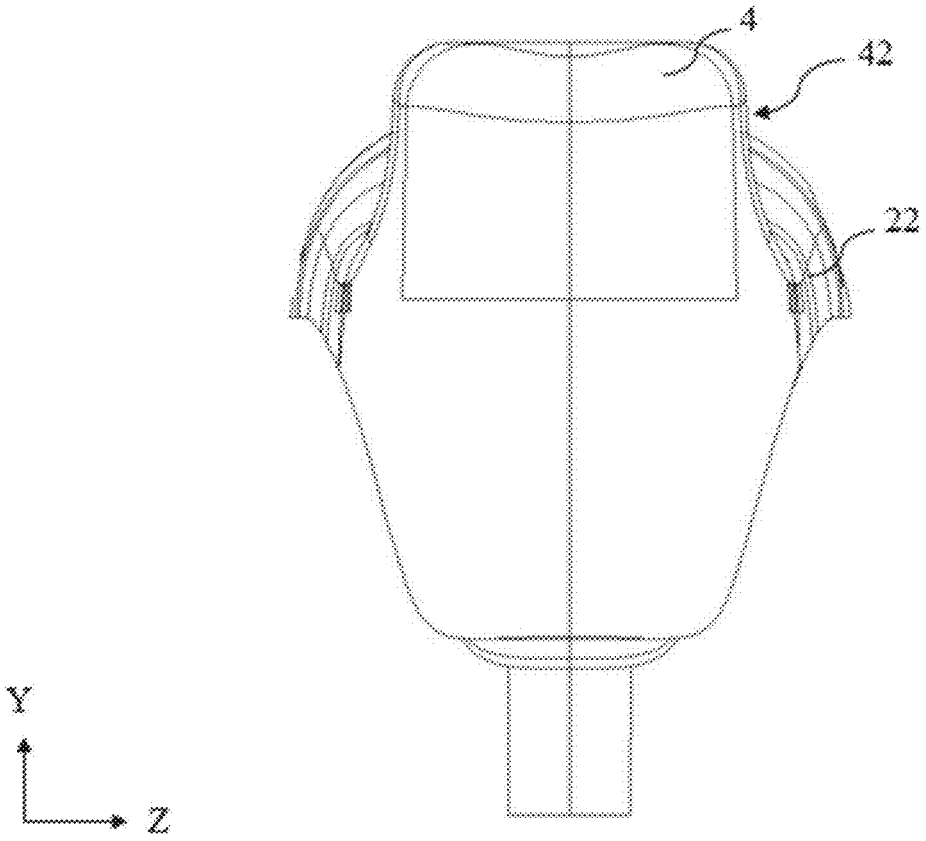
FIG. 9 is a side schematic diagram of the second part of the handle of the pull handle device according to some implementations of the present disclosure.
Figure 10:
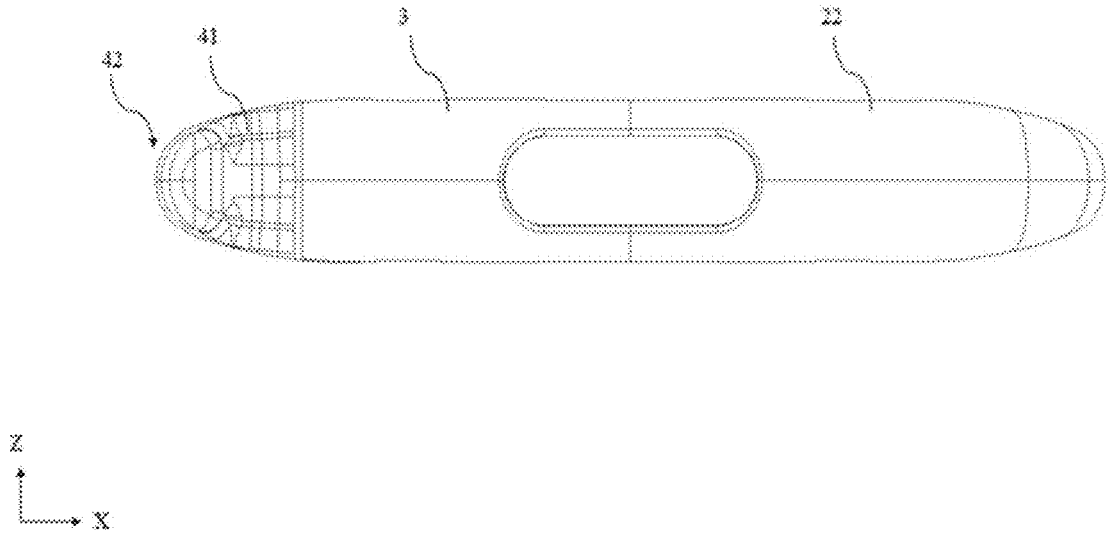
FIG. 10 is a top schematic diagram of the second part of the handle of the pull handle device according to some implementations of the present disclosure.
Figure 11:
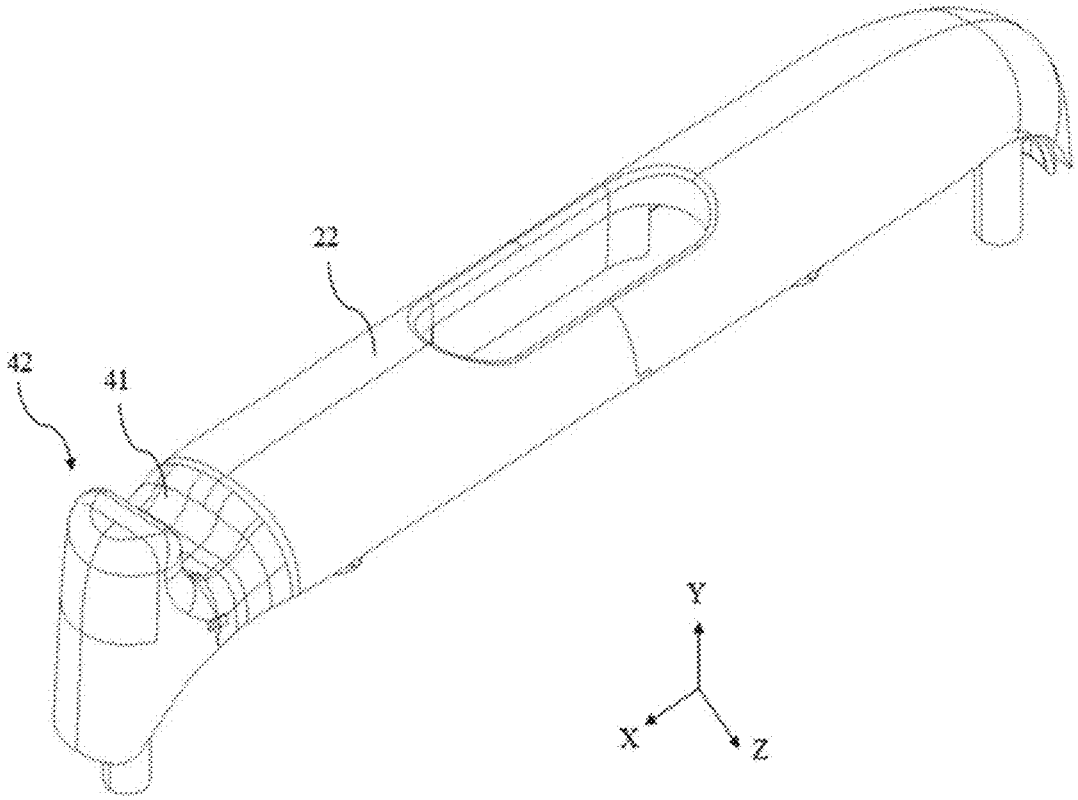
FIG. 11 and FIG. 12 are perspective schematic diagrams of the second part of the handle of the pull handle device according to some implementations of the present disclosure.
Figure 12:
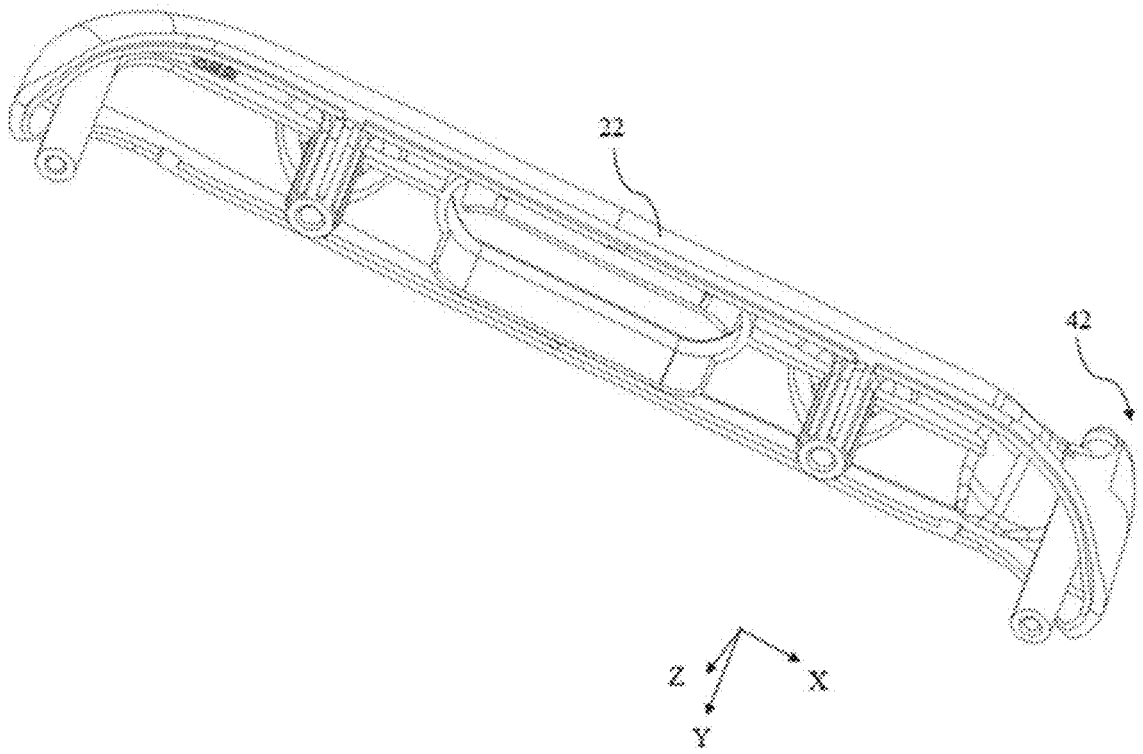

In some implementations, continuing to refer to FIG. 7, the groove 41 further includes: a vertical portion 54. The vertical portion 54 is connected to the curved portion 53, the curved portion 53 is located between the inclined portion 52 and the vertical portion 54, and the vertical portion 54 is provided by a side wall of the protrusion 42. In some implementations, the vertical portion 54 may be used to block the hung structure from disengaging from the groove 41, and in some cases, bear the component of the force of the hung structure in the second direction.

In some implementations, continuing to refer to FIG. 7, the groove 41 further includes: a first chamfer 51 connected to the inclined portion 52 and a second chamfer 55 connected to the vertical portion 54. In some implementations, the first chamfer 51 and the second chamfer 55 are used to smooth the curve near the groove to obtain a good gripping feel. In some implementations, the first chamfer 51 and the second chamfer 55 can better disperse the force, allowing the handle 20 to bear greater weight.

In some implementations, the protrusion 42 has a height in the first direction greater than a height of the gripping structure 3 in the first direction, for example, the upper surface of the protrusion 42 protrudes above the upper surface of the gripping structure 3. In some implementations, the higher design of the protrusion 42 allows the hung structure to be stacked in the groove 41. In some implementations, the higher design of the protrusion 42 also allows the groove 41 to accommodate larger and/or heavier hung structures. In some implementations where the hung structure is flexible, the higher design of the protrusion 42 allows it to have more contact area with the hung structure to bear a smaller lateral force.

Figure 3:
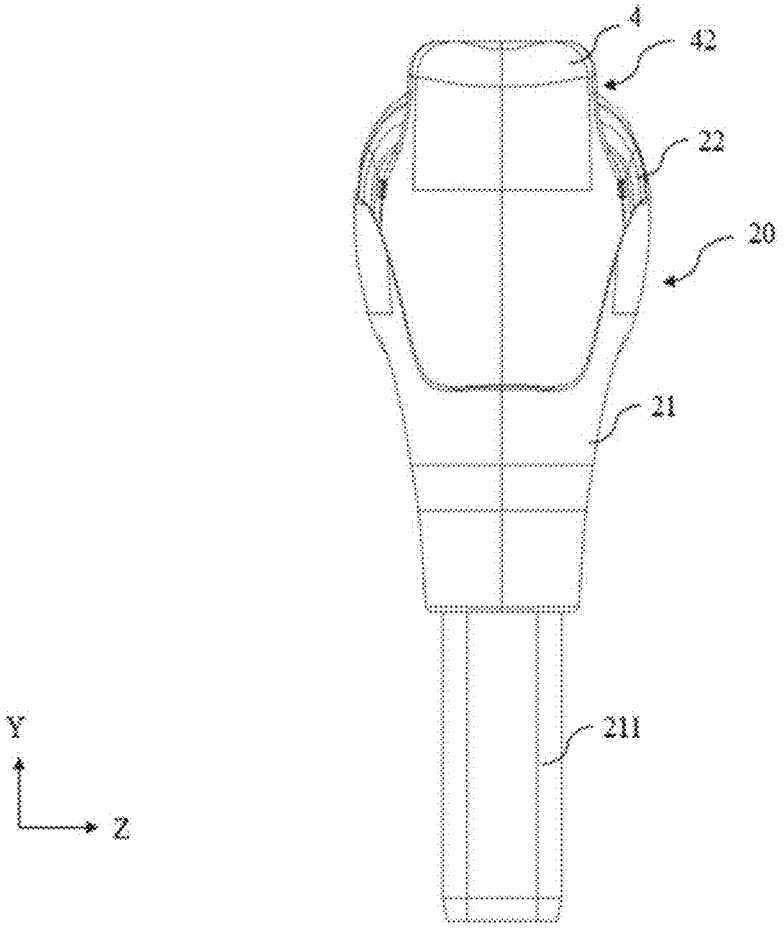
FIG. 3 is a side schematic diagram of the handle of the pull handle device according to some implementations of the present disclosure.
Figure 4:
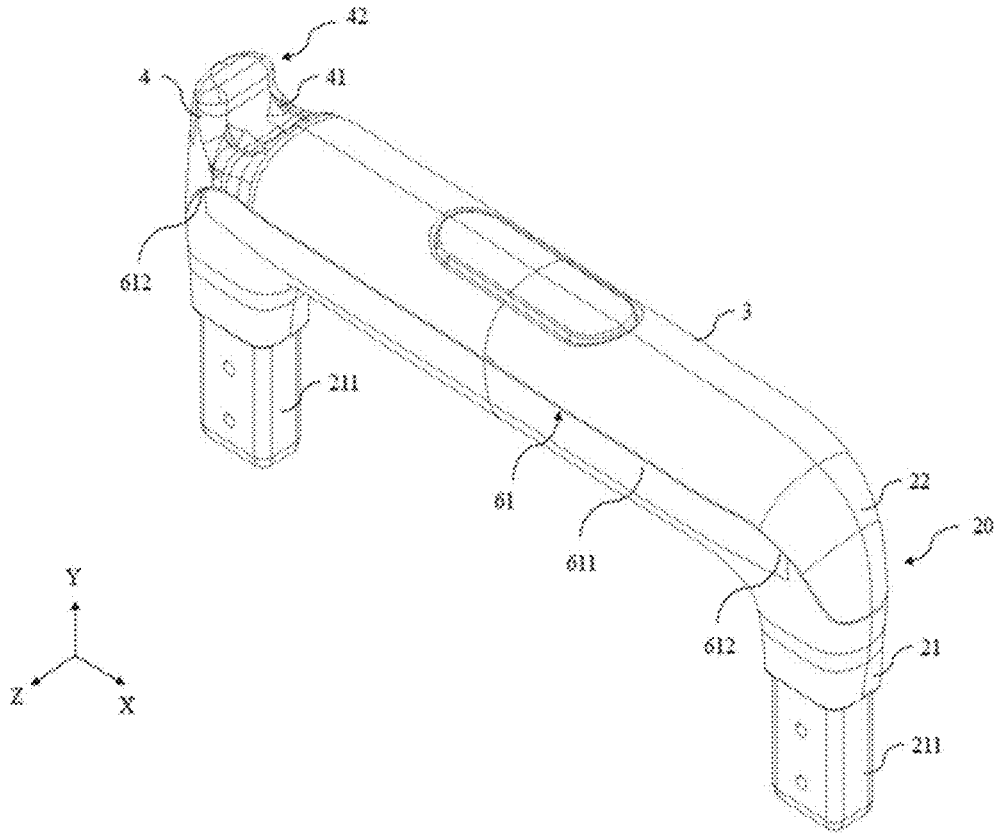
FIG. 4 and FIG. 5 are perspective schematic diagrams of the handle of the pull handle device according to some implementations of the present disclosure.
Figure 5:
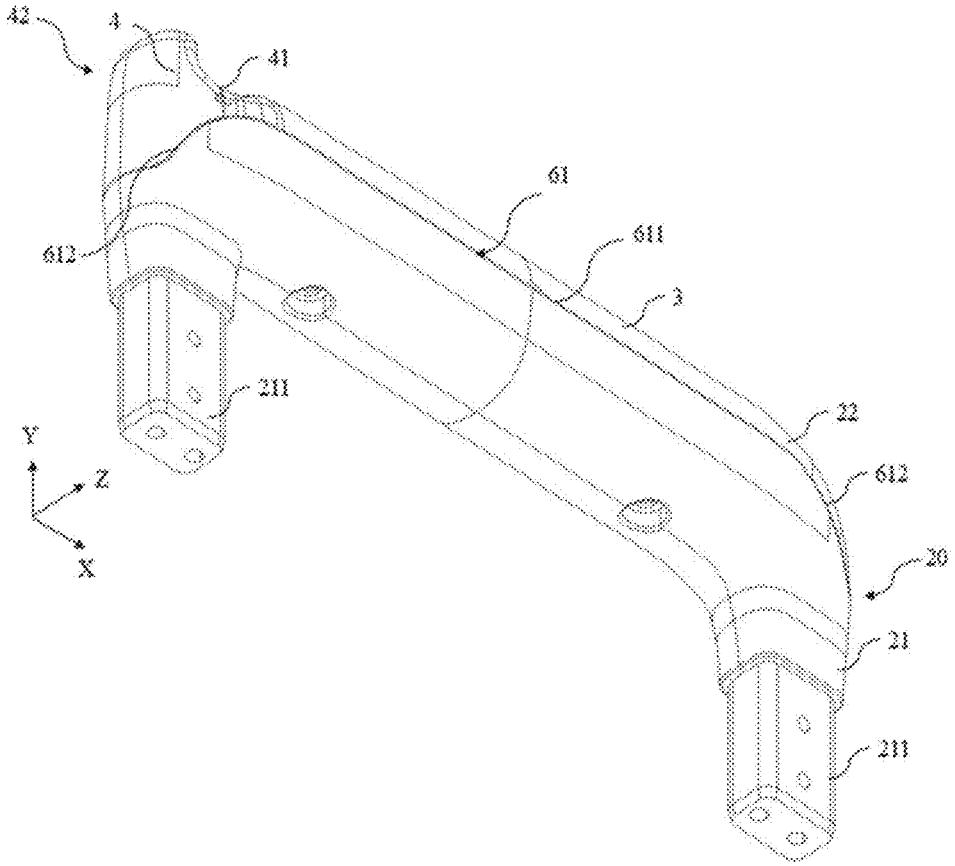

In some implementations, referring to FIG. 3, an upper portion of the protrusion 42 in a third direction (for example, the Z-axis direction) has a width greater than a width of a lower portion of the protrusion 42 in the third direction. The third direction is perpendicular to the first direction and the second direction. In some implementations, the profile of both sides of the protrusion 42 in the third direction has a feature of gradually narrowing upward, so that the object can smoothly fall into the bottom of the groove 41 when hanging without being blocked by the protrusion 42. In some implementations, as shown in FIG. 3, the protrusion 42 in the third direction may be a structure that is mirror-symmetrical along the axis in the first direction (for example, the Y-axis direction). In some implementations, the profile of both sides of the protrusion 42 in the third direction may be a concave arc line that is concave toward the central axis of the protrusion 42 in the third direction.

In some implementations, the maximum width of the protrusion 42 in the third direction is less than the maximum width of the gripping structure 3 in the third direction. In some implementations, the maximum width of the groove 41 in the third direction is less than the maximum width of the gripping structure 3 in the third direction. In some implementations, due to the downward gravity provided by the hung object, the hung structure tends to enter a lower position (for example, the position in the Y-axis direction) and a narrower position (for example, the width dimension in the Z-axis direction) along the wider, smooth gripping structure 3. The protrusion 42 and the groove 41 with a smaller width in the third direction allow the hung structure to remain in this position, without sliding to the gripping structure 3 due to vibration caused by dragging the container.

In one or more implementations of the present disclosure, referring to FIG. 1 and FIG. 2, the handle 20 includes a first part 21 connecting the two rods 10 and a second part 22 fixed above the first part 21, the second part 22 enclosing an upper surface of the first part 21 and a part of both sides of the first part 21, where an upper portion of the second part 22 forms the hanging structure 4. In some implementations, the second part 22 has an n-shaped structure.

In some implementations, the first part 21 and the second part 22 are respectively integrally injection-molded, so that both have greater strength.

In some implementations, a lower portion of the first part 21 forms two rod connecting portions 211, respectively for connecting the two rods 10.

In some implementations, referring to FIG. 1 and FIG. 2, in conjunction with FIG. 8 to FIG. 12, there is a parting line 61 between the second part 22 and the first part 21, the parting line 61 including: a straight-line portion 611 in the middle and arc portions 612 on both sides of the straight-line portion 611. In some implementations, the second part 22 encloses a part of both sides of the first part 21 at the arc portions 612. In some implementations, the second part 22 may further completely enclose both sides of the first part 21.

In some implementations, the arc portions 612 extend from the first direction (for example, the Y-axis direction) toward the second direction (for example, the X-axis direction), so that when the second part 22 is connected to the first part 21, the first part 21 can prevent the second part 22 from moving in the X-axis direction, avoiding the second part 22 from falling off relative to the first part 21.

For example, referring to FIG. 1, when the hung structure (such as the handle of a bag) is hung into the groove 41, the second part 22 is subjected to a force directed to the lower left, which is decomposed into a downward normal force in the Y-axis direction and a leftward lateral force in the X-axis direction. The normal force is borne by the rod 10 through the second part 22 and the first part 21, while the lateral force is mainly borne by the fixed connection between the second part 22 and the first part 21. In some implementations, the first part 21 and the second part 22 may be fixedly connected by fasteners, and the lateral force is mainly borne by the fasteners (for example, the fasteners are arranged in the Y-axis direction and bear the lateral shear force). In some implementations, the arc portions 612 of the parting line 61 also bear part of the lateral force, thereby reducing the working pressure of the fasteners and improving the overall strength of the mechanism. For example, continuing to refer to FIG. 1, when the second part 22 has a tendency to move to the left in FIG. 1 under the action of the hung structure, the structure at the arc portion 612 on the right side of the second part 22 is blocked by the corresponding position of the first part 21, thereby resisting this movement tendency.

In one or more implementations of the present disclosure, the minimum distance from the inclined portion 52 to the parting line 61 in the first direction is not less than ½ of the minimum distance from the gripping structure 3 to the parting line 61 in the first direction. In some implementations, the minimum distance from the curved portion 53 to the parting line 61 in the first direction is not less than ½ of the minimum distance from the gripping structure 3 to the parting line 61 in the first direction. In some implementations, the extension direction of the inclined portion 52 may be determined based on the extension direction of the parting line 61, for example, the inclined portion 52 may be parallel to a certain tangent of the arc portion 612 of the parting line 61, specifically, a relatively gentle tangent of the arc portion 612. In some implementations, the minimum distance between the inclined portion 52 and the curved portion 53 and the parting line 61 determines the narrowest part of the second part 22 in the first direction (Y-axis direction). In some implementations, controlling the width of the narrowest part to be not less than a certain proportion of the width of the second part 22 at the gripping structure 3 is used to control the overall strength of the second part 22.

Figure 6:
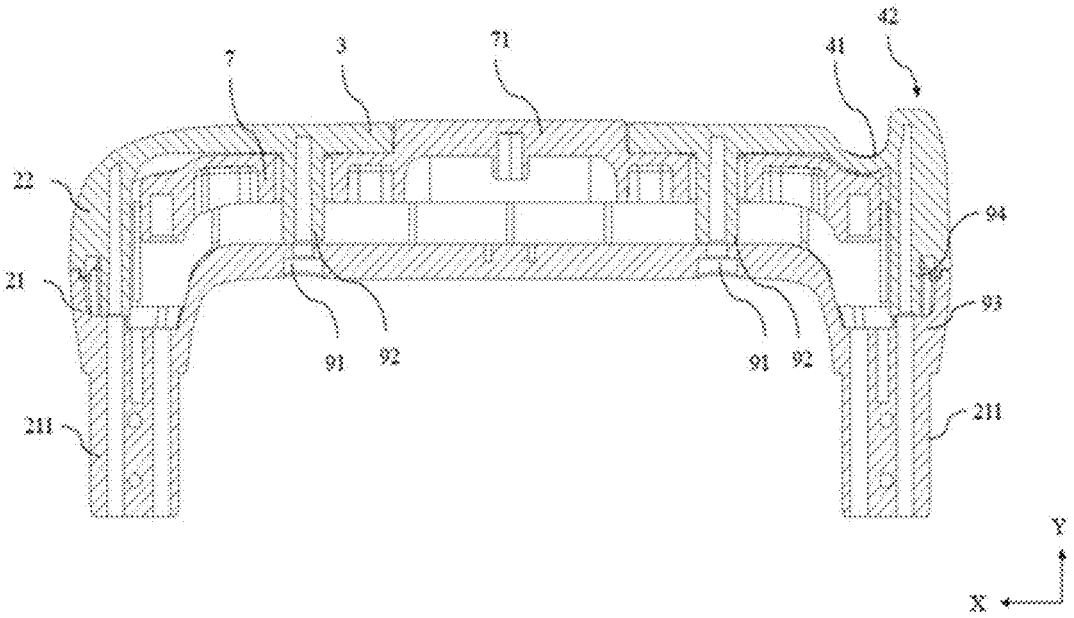
FIG. 6 is a sectional schematic diagram of the handle of the pull handle device according to some implementations of the present disclosure.

In one or more implementations of the present disclosure, referring to FIG. 6, the first part 21 and the second part 22 enclose to form an accommodating space, and a button mechanism 7 is provided inside the accommodating space. In some implementations, a part of a button 71 of the button mechanism 7 protrudes from the second part 22 in the first direction. In some implementations, by pressing the button 71, the rod 10 can be locked relative to other mechanisms, thereby allowing the user to pull out or retract the pull handle.

In some implementations, the first part 21 and the second part 22 are fixedly connected by one or more fasteners. In some implementations, the fastener may be a threaded fastener such as a screw or bolt, or may be a rivet or other structure. In some implementations, the fastener may be arranged along the second direction.

In some implementations, one of the first part 21 or the second part 22 is provided with a positioning hole 91, and the other of the first part 21 and the second part 22 is provided with a first positioning post 92. The fastener passes through the positioning hole 91 and is fixedly connected to the first positioning post 92, so as to connect the first part 21 and the second part 22. In some implementations, the first positioning post 92 is located within the accommodating space, and the first positioning post 92 abuts an inner wall of one of the first part 21 or the second part 22. For example, the lower surface of the first part 21 is provided with a positioning hole 91, the lower surface of the second part 22 extends downward to form the first positioning post 92, and the lower end of the first positioning post 92 abuts the inner wall of the first part 21. In some implementations, the cooperation between the first positioning post 92 and the inner wall of the first part 21 provides support for the accommodating space to protect other mechanisms inside the accommodating space. In some implementations, the number of the first positioning post 92 may include a plurality.

In one or more implementations of the present disclosure, referring to FIG. 6, the first part 21 is provided with a positioning protrusion 93, and the second part 22 is provided with a second positioning post 94, and the second positioning post 94 abuts the positioning protrusion 93. In some implementations, the range of a projection of the second positioning post 94 along the second direction is within a range of a projection of the rod 10 along the second direction. That is, the second positioning post 94 vertically overlaps with the rod 10.

In some implementations, in order to arrange the button mechanism, the handle 20 may be designed as a hollow structure. In some implementations, in order to realize the hollow structure and considering the aforementioned lateral force, the handle 20 may be designed with an upper and lower parting. In some implementations, the first part 21 and the second part 22 of the handle 20 may be thin-walled structures to provide a larger accommodating space. In some implementations, in order to increase the strength of the first part 21 and the second part 22, reinforcing ribs may be provided on the inner walls of the first part 21 and the second part 22.

In some implementations, the cooperation between the second positioning post 94 and the positioning protrusion 93 provides support for the accommodating space to protect other mechanisms inside the accommodating space.

In some implementations, the second positioning post 94 is located at the protrusion 42. In some implementations, referring to FIG. 6, the load borne by the groove 41 can be transferred to the positioning protrusion 93 through the adjacent second positioning post 94, thereby transferred to the second part 22, and further transferred to the rod 10.

In some implementations, a fastener for fastening the first part 21 and the second part 22 may also be further provided at the second positioning post 94. In some implementations, the fastener may pass through the positioning protrusion 93 and be fastened to the second positioning post 94.

In one or more implementations of the present disclosure, the side walls on both sides of the handle 20 in the second direction (for example, the X-axis direction) are curved. In some implementations, the side walls on both sides of the handle 20 in the third direction (for example, the Z-axis direction) are curved, and the third direction is perpendicular to the first direction and the second direction. In some implementations, referring to FIG. 14, the pull handle device 100 can provide a limiting function for another container (for example, the backpack 85 shown in FIG. 14) supported on a container (for example, the suitcase 81 shown in FIG. 14) including the pull handle device 100. In some implementations, the backpack 85 may include a transverse limiting strap 851, and by fitting the limiting strap 851 over the outside of the pull handle device 100, the backpack 85 can be limited, allowing the backpack 85 to be placed on the suitcase 81 and to be dragged along with the suitcase 81.

In one or more implementations of the present disclosure, the gripping structure 3 of the handle 20 has a width of 130-150 mm in the second direction. For example, the width of the gripping structure in the second direction may be 130 mm, 132 mm, 135.8 mm, 140 mm, 140.5 mm, 143 mm, 144 mm, 147.8 mm, or 150 mm. In some implementations, the width of the gripping structure 3 in the second direction matches the width of the palm, providing a good gripping feel.

In some implementations, the groove 41 has a depth of 7-9 mm in the first direction, for example, 7.8-8.3 mm. For example, the depth of the groove 41 in the first direction may be 7.2 mm, 7.56 mm, 7.8 mm, 7.9 mm, 8.2 mm, 8.3 mm, 8.85 mm, or 9 mm. In some implementations, the greater depth of the groove 41 in the first direction provides good stability for hung objects, preventing the hung structure of the hung object from coming out.

In some implementations, the groove 41 has a width of 11-13 mm in the second direction, for example, 12-12.5 mm. For example, the width of the groove 41 in the second direction may be 11 mm, 11.2 mm, 11.5 mm, 11.88 mm, 12 mm, 12.3 mm, 12.46 mm, 12.5 mm, 12.8 mm, or 13 mm. In some implementations, the greater width of the groove 41 in the second direction allows the hung structures of multiple hung objects to be stacked, or allows larger hung structures to be hung.

In one or more implementations of the present disclosure, the pull handle device can bear a load of 3 kg. In some implementations, taking a 20-inch suitcase equipped with the pull handle device provided by the present disclosure as a test object, the suitcase body bears a load of 15 kg, and a load of 1 kg is applied to the hanging structure of the pull handle device at a frequency of 15 times per minute by a vibration impact testing machine. The force application position is selected at the inclined portion and/or the curved portion, and the hook state is observed. Under the above test conditions, 200 tests are conducted, and no deformation or damage of the protrusion is observed, nor is any displacement or detachment of the second part relative to the first part observed. In some implementations, based on the above test conditions, the load is further increased to 2 kg for 200 tests, and the test results are normal. In some implementations, based on the above test conditions, the load is further increased to 3 kg for 500 tests, and the test results are normal. It can be seen that the pull handle device provided by the present disclosure can stably bear a load of at least 3 kg.

In some implementations, the pull handle device can further bear a load of 5 kg.

Figure 13:
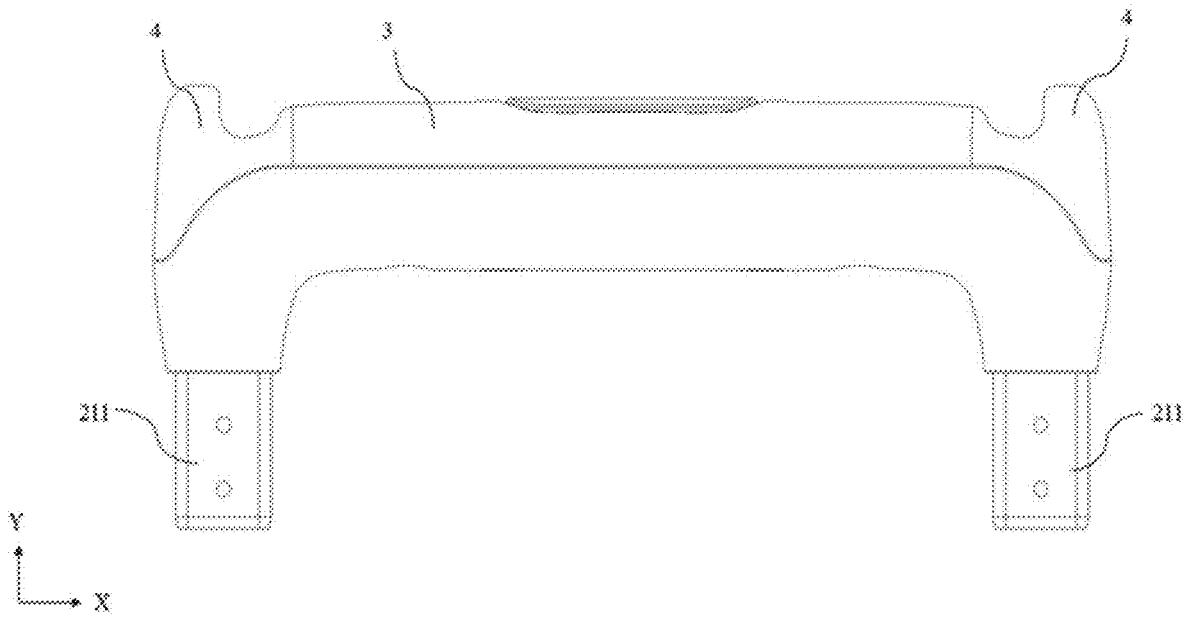
FIG. 13 is a schematic diagram of the handle of the pull handle device according to other implementations of the present disclosure.

In one or more implementations of the present disclosure, referring to FIG. 13, a hanging structure 4 is provided on each side of the gripping structure 3 of the handle 20. In some implementations, the two hanging structures 4 are arranged in mirror symmetry. In some implementations, each of the two hanging structures 4 has the same structure and configuration as the hanging structure 4 described above.

In one or more implementations of the present disclosure, a container with pull handle is also provided, which includes a container and the above pull handle device. In some implementations, the container may be a flatbed trailer, transfer box, transfer frame, storage box, backpack, suitcase (for example, a trolley case), movable furniture (for example, a table), movable appliances (for example, a refrigerator), etc.

Figure 14:
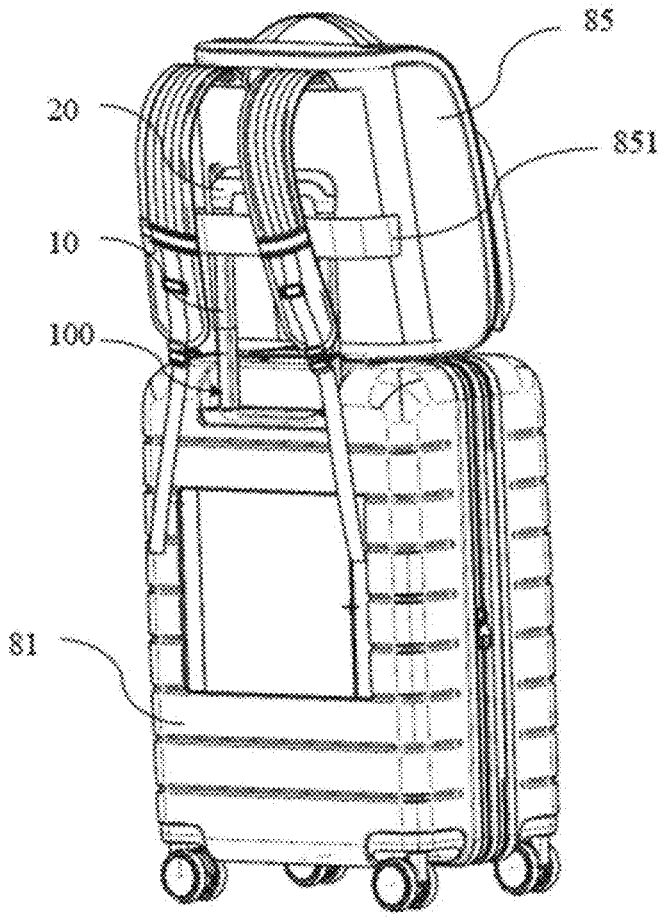
FIG. 14 is a schematic diagram of a container with pull handle according to some implementations of the present disclosure.
Figure 15:
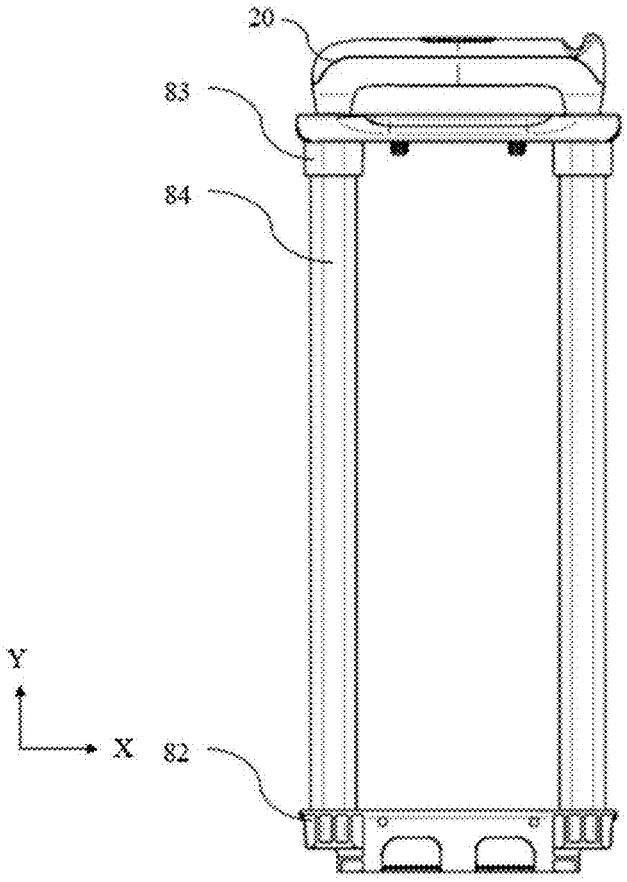
FIG. 15 is a schematic diagram of the device of the pull handle device and the rod tube according to some implementations of the present disclosure.

In some implementations, referring to FIG. 14 and FIG. 15, the container with pull handle may specifically include a container (for example, suitcase 81), a rod bottom support 82 provided at a lower part of the suitcase 81, a rod main plate 83 provided at an upper part of the suitcase 81, and a rod tube 84 provided between the rod bottom support 82 and the rod main plate 83. In some implementations, a part of the rod 10 of the pull handle device may be slidably provided within the rod tube 84.

In one or more implementations of the present disclosure, a suitcase is also provided, which includes the above pull handle device.

The beneficial effects that may be brought by the implementations of the present disclosure include but are not limited to: (1) providing a hanging structure on the handle to allow the user to hang objects on the hanging structure; (2) guiding the hung structure of the hung object to the curved portion through the inclined portion, and adjusting the force direction through the curved portion, so that most of the force is borne by the rod, rather than by the suspended part of the handle; (3) providing a wider hanging position through the setting of the inclined portion and the curved portion, and being able to bear a greater load; (4) bearing the lateral component of the force through the protrusion, and dispersing the force through the first chamfer and the second chamfer to provide strong structural stability; (5) making the second part enclose the side surface of the first part through the design of the parting line, to assist in resisting the displacement effect of the lateral component of the force on the second part; (6) the first positioning post and the second positioning post provide fixation of the first part and the second part, while supporting the accommodating space, so that the handle as a whole has high strength; (7) the arrangement of the second positioning post allows the load of the groove to be transferred to the first part through the second positioning post, rather than being transferred to the first part through the farther side wall of the second part, which has better transfer efficiency and provides greater strength.

The basic concepts have been described above. Obviously, for those skilled in the art, the above detailed disclosure is only as an example and does not constitute a limitation of the present disclosure. Although not explicitly stated here, those skilled in the art may make various modifications, improvements, and corrections to the present disclosure. Such modifications, improvements, and corrections are taught in the present disclosure, so such modifications, improvements, and corrections still fall within the spirit and scope of the exemplary implementations of the present disclosure.

What is claimed is:

1. A pull handle device, comprising:

two rods arranged along a first direction; and a handle arranged along a second direction to connect the two rods, wherein:

the handle comprises:

a gripping structure; and a hanging structure provided on at least one side of the gripping structure, the hanging structure comprising a groove and a protrusion connected to each other, the protrusion being located on a side of the handle, and the groove being connected to the protrusion;

wherein a projection of the groove along the second direction overlaps at least partially with a projection of the two rods along the second direction, the groove comprising at least an inclined portion and a curved portion connected to each other;

wherein the inclined portion is inclined with respect to the second direction, the inclined portion being configured to, when a hung structure of a hung object comes into contact with the inclined portion, guide, by the inclined portion, at least a part of the hung structure to the curved portion;

wherein the curved portion is configured to, when the hung structure applies force to the curved portion due to gravity of the hung object, create an angle between a direction of the force and the first direction, with the direction of the force pointing away from a center of the handle;

wherein the gripping structure has a width of 130-150 mm in the second direction;

wherein the groove has a depth of 7-9 mm in the first direction; and wherein the groove has a width of 11-13 mm in the second direction, and the first direction and the second direction are perpendicular to each other.

2. The pull handle device according to claim 1, wherein the inclined portion comprises a first end and a second end, the first end having a height in the first direction greater than a height of the second end in the first direction, and the second end being connected to the inclined portion.

3. The pull handle device according to claim 1, wherein the groove further comprises a vertical portion connected to the curved portion, wherein the curved portion is located between the inclined portion and the vertical portion, and wherein the vertical portion is provided by a side wall of the protrusion.

4. The pull handle device according to claim 3, wherein the groove further comprises a first chamfer connected to the inclined portion and a second chamfer connected to the vertical portion.

5. The pull handle device according to claim 1, wherein a height of the protrusion in the first direction is greater than that of the gripping structure in the first direction.

6. The pull handle device according to claim 1, wherein a width of an upper portion of the protrusion in a third direction is greater than that of a lower portion of the protrusion in the third direction, and wherein the third direction is perpendicular to the first direction and the second direction.

7. The pull handle device according to claim 1, wherein the handle comprises a first part connecting the two rods and a second part fixed above the first part, the second part enclosing an upper surface of the first part and a part of both sides of the first part; and wherein an upper portion of the second part forms the hanging structure.

8. The pull handle device according to claim 7, wherein a lower portion of the first part forms two rod connecting portions for connecting the two rods respectively.

9. The pull handle device according to claim 7, wherein a parting line is provided between the second part and the first part, and wherein the parting line comprises a straight-line portion in the middle and arc portions on both sides of the straight-line portion.

10. The pull handle device according to claim 9, wherein a minimum distance from the inclined portion to the parting line in the first direction is not less than ½ of a minimum distance from the gripping structure to the parting line in the first direction; and wherein a minimum distance from the curved portion to the parting line in the first direction is not less than ½ of a minimum distance from the gripping structure to the parting line in the first direction.

11. The pull handle device according to claim 7, wherein the first part and the second part enclose to form an accommodating space, wherein a button mechanism is provided inside the accommodating space, and wherein a part of a button of the button mechanism protrudes from the second part.

12. The pull handle device according to claim 11, wherein the first part and the second part are fixedly connected by one or more fasteners;

wherein one of the first part or the second part is provided with a positioning hole, the other of the first part and the second part is provided with a first positioning post, and the fastener passes through the positioning hole and is fixedly connected to the first positioning post; and wherein the first positioning post is located within the accommodating space, and the first positioning post abuts an inner wall of one of the first part and or second part.

13. The pull handle device according to claim 7, wherein the first part and the second part enclose to form an accommodating space;

wherein the first part is provided with a positioning protrusion, the second part is provided with a second positioning post, and the second positioning post abuts the positioning protrusion; and wherein a range of a projection of the second positioning post along the second direction is within a range of a projection of the two rods along the second direction.

14. The pull handle device according to claim 1, wherein side walls of the handle on both sides of the handle in the second direction are curved; and wherein the side walls of the handle on both sides of the handle in a third direction are curved, the third direction being perpendicular to the first direction and the second direction.

15. The pull handle device according to claim 1, wherein a range of a projection of the groove along the second direction is within a range of a projection of the two rods along the second direction.

16. The pull handle device according to claim 1, wherein each side of the gripping structure of the handle is provided with the hanging structure.

17. A container with pull handle, comprising:

a container; and a pull handle device, wherein the pull handle device comprises:

two rods arranged along a first direction; and a handle arranged along a second direction to connect the two rods, wherein the handle comprises:

a gripping structure; and a hanging structure provided on at least one side of the gripping structure, the hanging structure comprising a groove and a protrusion connected to each other, the protrusion being located on a side of the handle, and the groove being connected to the protrusion;

wherein a projection of the groove along the second direction overlaps at least partially with a projection of the two rods along the second direction, the groove comprising at least an inclined portion and a curved portion connected to each other;

wherein the inclined portion is inclined with respect to the second direction, the inclined portion being configured to: when a hung structure of a hung object comes into contact with the inclined portion, guide, by the inclined portion, at least a part of the hung structure to the curved portion;

wherein the curved portion is configured to, when the hung structure applies force to the curved portion due to gravity of the hung object, create an angle between a direction of the force and the first direction, with the direction of the force pointing away from a center of the handle;

wherein the gripping structure has a width of 130-150 mm in the second direction;

wherein the groove has a depth of 7-9 mm in the first direction; and wherein the groove has a width of 11-13 mm in the second direction, and the first direction and the second direction are perpendicular to each other.

18. The container with pull handle according to claim 17, comprising:

a container;

a rod bottom support provided at a lower part of the container;

a rod main plate provided at an upper part of the container; and a rod tube provided between the rod bottom support and the rod main plate, wherein a part of the two rods of the pull handle device is slidably provided within the rod tube.

19. A suitcase, comprising:

a pull handle device, wherein the pull handle device comprises:

two rods arranged along a first direction; and a handle arranged along a second direction to connect the two rods, wherein the handle comprises:

a gripping structure; and a hanging structure provided on at least one side of the gripping structure, the hanging structure comprising a groove and a protrusion connected to each other, the protrusion being located on a side of the handle, and the groove being connected to the protrusion;

wherein a projection of the groove along the second direction overlaps at least partially with a projection of the two rods along the second direction, the groove comprising at least an inclined portion and a curved portion connected to each other;

wherein the inclined portion is inclined with respect to the second direction, the inclined portion being configured to: when a hung structure of a hung object comes into contact with the inclined portion, guide, by the inclined portion, at least a part of the hung structure to the curved portion;

wherein the curved portion is configured to, when the hung structure applies force to the curved portion due to gravity of the hung object, create an angle between a direction of the force and the first direction, with the direction of the force pointing away from a center of the handle;

wherein the gripping structure has a width of 130-150 mm in the second direction;

wherein the groove has a depth of 7-9 mm in the first direction; and wherein the groove has a width of 11-13 mm in the second direction, and the first direction and the second direction are perpendicular to each other.

* * * * *